United States Patent [19]

Wind

[11] Patent Number: 4,480,748

[45] Date of Patent: Nov. 6, 1984

[54] SHIPPING PALLET AND CONTAINER

[75] Inventor: Joseph H. Wind, Taylors, S.C.

[73] Assignee: Bigelow-Sanford, Inc., Greenville, S.C.

[21] Appl. No.: 434,173

[22] Filed: Oct. 13, 1982

Related U.S. Application Data

[63] Continuation-in-part of Ser. No. 295,524, Aug. 24, 1981, Pat. No. 4,413,737, which is a continuation-in-part of Ser. No. 229,195, Jan. 28, 1981, abandoned.

[51] Int. Cl.[3] ..... B65D 19/00; B65D 19/38; B65D 21/02

[52] U.S. Cl. ..... 206/386; 108/55.3; 206/511; 206/599; 206/600; 220/4 F; 217/43 A

[58] Field of Search ..... 206/386, 595, 599, 600, 206/508, 509, 510, 511; 217/43 A; 108/55.3; 220/22.3, 4 F

[56] References Cited

U.S. PATENT DOCUMENTS

| | | | |
|---|---|---|---|
| 2,444,326 | 6/1948 | Baker | 108/55.3 |
| 3,424,110 | 1/1969 | Toot . | |
| 3,699,901 | 11/1972 | Cook . | |
| 3,921,540 | 11/1975 | Melnick | 206/386 |
| 4,000,704 | 1/1977 | Griffin | 206/599 |
| 4,254,873 | 3/1981 | Cook | 206/599 |
| 4,358,035 | 11/1982 | Heidecker | 220/22.3 |

FOREIGN PATENT DOCUMENTS

| | | | |
|---|---|---|---|
| 2510547 | 9/1976 | Fed. Rep. of Germany . | |
| 2013615 | 8/1979 | United Kingdom | 206/386 |

*Primary Examiner*—George E. Lowrance
*Attorney, Agent, or Firm*—Bell, Seltzer, Park & Gibson

[57] ABSTRACT

A shipping pallet is disclosed which comprises a unitary sheet of material and which is so constructed so as to be usable with another substantially identical pallet to serve as a bottom and top of a shipping container for transporting and storing a product. The pallet comprises a base with a plurality of a foot means projecting from one side thereof, a first sleeve receiving groove extending adjacent the periphery of the pallet on the side opposite the foot means, and a second sleeve receiving groove on the same side of the pallet and positioned so as not to extend beyond the confines of the first groove. The two grooves are constructed and arranged so as to each receive a sleeve therein of different cross-sectional configurations, such as either a square sleeve or an octagonal sleeve, and with the opposite ends of the sleeve being positioned in the corresponding one of the first and second grooves. The foot means of the pallets are configured in such a way so as to prevent lateral shifting between the containers when stacked, and such stacking may be accomplished with the pallets being in any relative orientation. In addition, the pallets may be nested in any relative orientation. The pallets also include flat surfaces permitting the same to be gripped by a suction transfer device, with the surfaces being accessible from either side of the pallet.

23 Claims, 19 Drawing Figures

SHIPPING PALLET AND CONTAINER

This is a continuation-in-part of application Ser. No. 295,524, filed Aug. 24, 1981 now U.S. Pat. No. 4,413,737, a continuation-in-part of application Ser. No. 229,195 filed Jan. 28, 1981, now abandoned.

In the above-identified parent application, there is disclosed a shipping pallet of the type formed of a single sheet of plastic material, and which is adapted to be used with another like pallet to form a shipping container. Specifically, the shipping container is composed of a central sleeve having a pallet secured to each of the top and bottom edges of the sleeve, and with the pallets disposed in opposite orientations.

The pallet of the prior application comprises a generally planar base and a plurality of foot members projecting from one side of the base and being adapted to act as vertical supporting legs. The projecting foot members are so configured and so arranged relative to each other such that a plurality of the pallets may be nested, and such that a pair of oppositely disposed pallets may be stacked in mating relation with respect to each other, with the projecting foot members serving to provide a lateral anti-shift interengagement. A rim extends peripherally around the base on the side opposite the foot means, and a sleeve receiving groove is provided alongside the rim. To form a shipping container, a sleeve is mounted between two oppositely disposed pallets, with the ends of the sleeve disposed in respective sleeve receiving grooves of the pallets, and with the foot members of the two pallets projecting outwardly in opposite directions. Strapping bands are employed for maintaining the assembly of the components.

The above-described pallet is seen to represent a substantial advance in the art, and has enjoyed substantial commercial success. However, the use of the pallet has been somewhat limited by the fact that it is able to mate with a sleeve of only one cross-sectional configuration, namely, a four-sided rectangular sleeve. This limitation restricts the flexibility of use of the pallet, and in addition, the four-sided sleeve utilized with the pallet is somewhat weak in load bearing capacity.

It is accordingly an object of the present invention to provide a pallet of the described type which is adapted to mate with sleeves of different cross-sectional configurations, to thereby permit shipping containers to be formed which have different configurations.

It is a more particular object of the present invention to provide a pallet of the described type and which is adapted to selectively mate with either a four-sided rectangular sleeve, or an eight-sided octagonal sleeve, to thereby permit use of the octagonal sleeve where increased load bearing capacity is required.

It is still another object of the present invention to provide a method of efficiently producing shipping containers composed of a sleeve and two like pallets disposed at the respective ends of the sleeve, wherein the pallets may be readily gripped and handled by a cooperating gripping device, and wherein shipping containers may be selectively produced which have different cross-sectional configurations while utilizing a common pallet design.

These and other objects and advantages of the present invention are achieved in the embodiments illustrated herein by the provision of a pallet of unitary construction and which is composed of a single sheet of material and comprises a base and a plurality of spaced-apart foot means projecting from a common side of the base. In addition, the pallet includes a first sleeve receiving groove provided adjacent the periphery of the pallet and on the side opposite the foot means, and a second sleeve receiving groove provided on the same side of the pallet as the first groove and positioned so as not to extend outwardly beyond the confines of the first groove. The second groove is constructed and arranged so as to receive a sleeve therein of different cross-sectional configuration than the sleeve which is adapted to be received in the first groove.

The pallet of the present invention is adapted to form a shipping container which is able to be stacked in mating relation with other shipping containers of substantially the same construction. More particularly, the shipping container comprises upper and lower pallets which are inverted relative to each other, with a sleeve extending between and positioned in engagement with the upper and lower pallets. In addition, the foot means of the two pallets each comprise at least one projecting member and a platform member adjacent each projecting member, with the platform members and projecting members being so constructed and arranged relative to each other that the projecting members of each pallet are adapted to abut the platform members of a pallet of an adjacent shipping container for providing a lateral anti-shift interengagement between the adjacent stacked containers.

The preferred embodiment of the pallet also includes a plurality of substantially flat areas which are present on each side of the pallet, and which are adapted for engagement by a suction device or the like for facilitating the handling and assembly of the pallets into shipping containers. Also, in the preferred embodiment, at least some of the spaced-apart foot means comprise a pair of spaced-apart projecting members and a pair of spaced-apart platform members and a bridging member interconnecting each of the pairs of projecting members for strengthening the same.

The present invention also involves a method of producing shipping containers which involves the steps of providing first and second stacks of pallets of the construction described above, and wherein the pallets of the second stack are inverted relative to the pallets of the first stack. The uppermost pallet is removed from the first stack and positioned on a supporting surface, and a sleeve is selected from a supply of sleeves having a cross-sectional configuration corresponding to one of the first and second sleeve receiving grooves of the pallet. The selected sleeve is positioned in the correspondingly configured one of the first and second grooves, and after the product has been deposited in the sleeve, the uppermost inverted pallet from the second stack is positioned on top of the sleeve so that the upper end of the sleeve is positioned within the correspondingly configured sleeve receiving groove of the inverted pallet. The assembly is then bindingly interconnected, with the ends of the sleeve thus being positioned in the respective grooves of the upper and lower pallets.

Some of the objects having been stated, other objects will appear as the description proceeds, when taken in connection with the accompanying drawings in which FIG. 1 is a perspective view of a shipping container which embodies the features of the present invention;

Referring more specifically to the drawings, a pallet which incorporates the features of the present invention is illustrated generally at 20. The illustrated embodiment of the pallet is composed of a unitary sheet of molded plastic material, and may be formed by a conventional vacuum molding process. Also, the illustrated pallet is generally square in plan view, and it includes a base 22, and a plurality of spaced-apart foot means projecting from a common side of the base.

Figure 9:
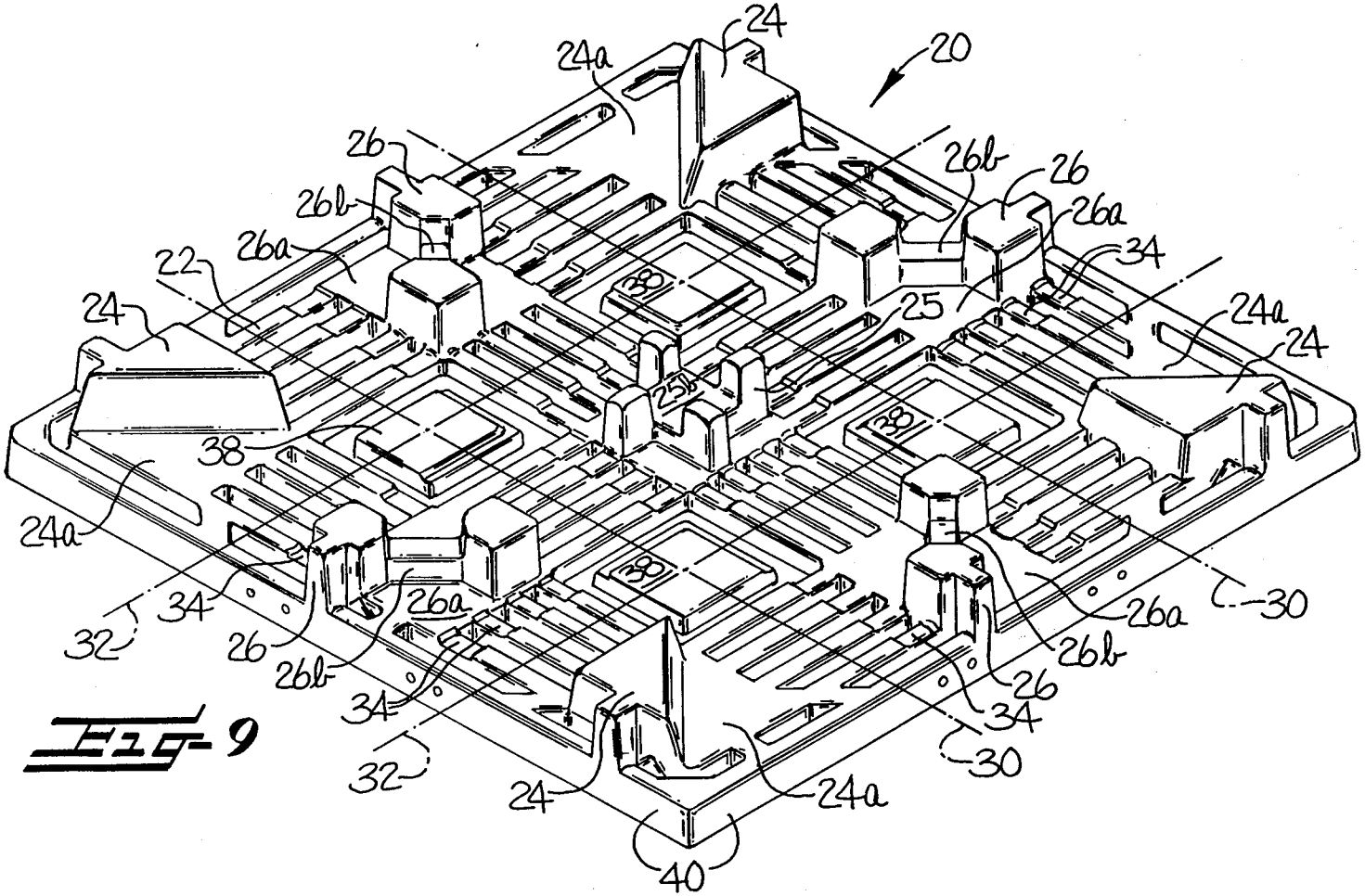
FIG. 9 is a bottom perspective view of the pallet.
Figure 10:
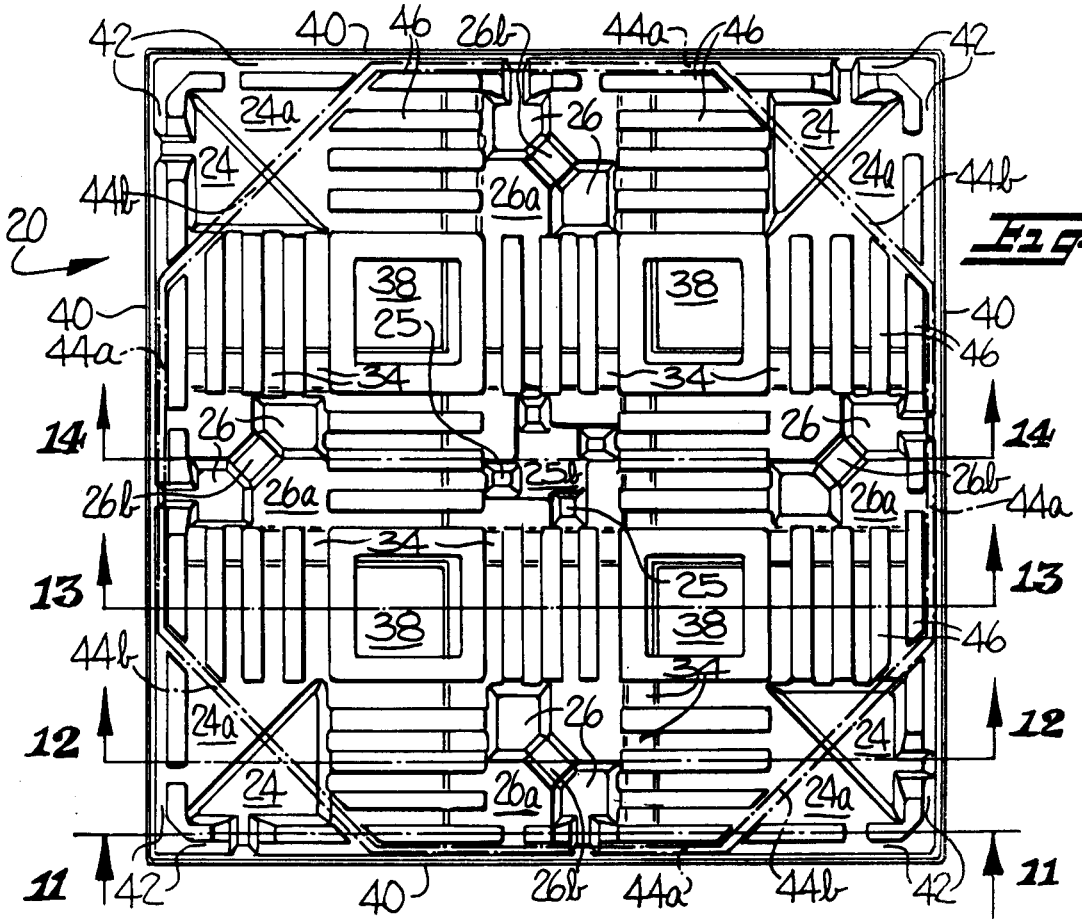
FIG. 10 is a top plan view of the pallet.
Figure 11:
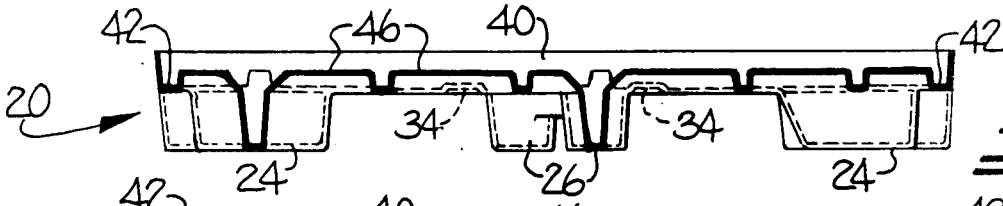
FIGS. 11–14 are sectional side elevation views of the pallet and taken substantially along the lines 11—11, 12—12, 13—13, and 14—14 respectively, of FIG. 10.
Figure 12:
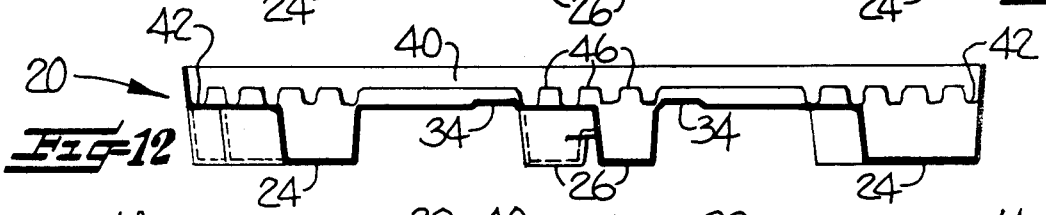
Figure 13:
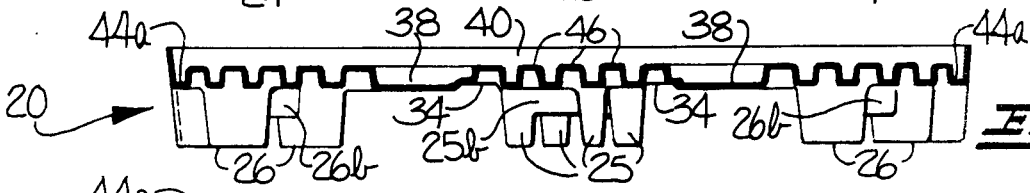
Figure 14:
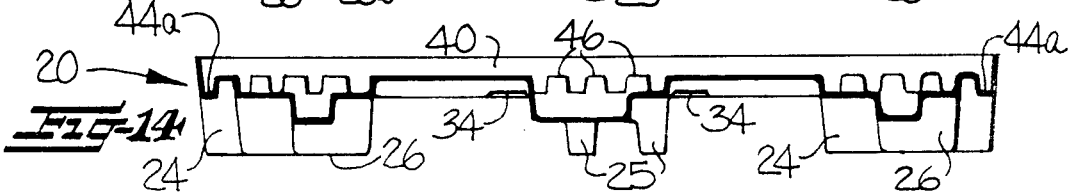

As best seen in FIG. 9, the foot means includes corner foot means 24 positioned in respective corner areas of the pallet, central foot means 25 positioned centrally of the pallet, and intermediate foot means 26 positioned between adjacent corner foot means. As best seen in FIG. 10, the corner foot means 24 includes a single projecting member of generally triangular cross-sectional outline, and an adjacent platform 24*a* of a similar outline. The central foot means 25 comprises four projecting members disposed in a staggered non-aligned array, and four adjacent platforms 25*a*. The intermediate foot means 26 each comprises two projecting members, and two adjacent platforms 26*a*. Also, a bridging member 25*b* interconnects the four projecting members of the central foot means for strengthening the same, with the bridging member 25*b* projecting from the base a lesser distance than each of the four projecting members. Similarly, a bridging member 26*b* interconnects the two projecting members of each of the intermediate foot means 26.

Figure 5:
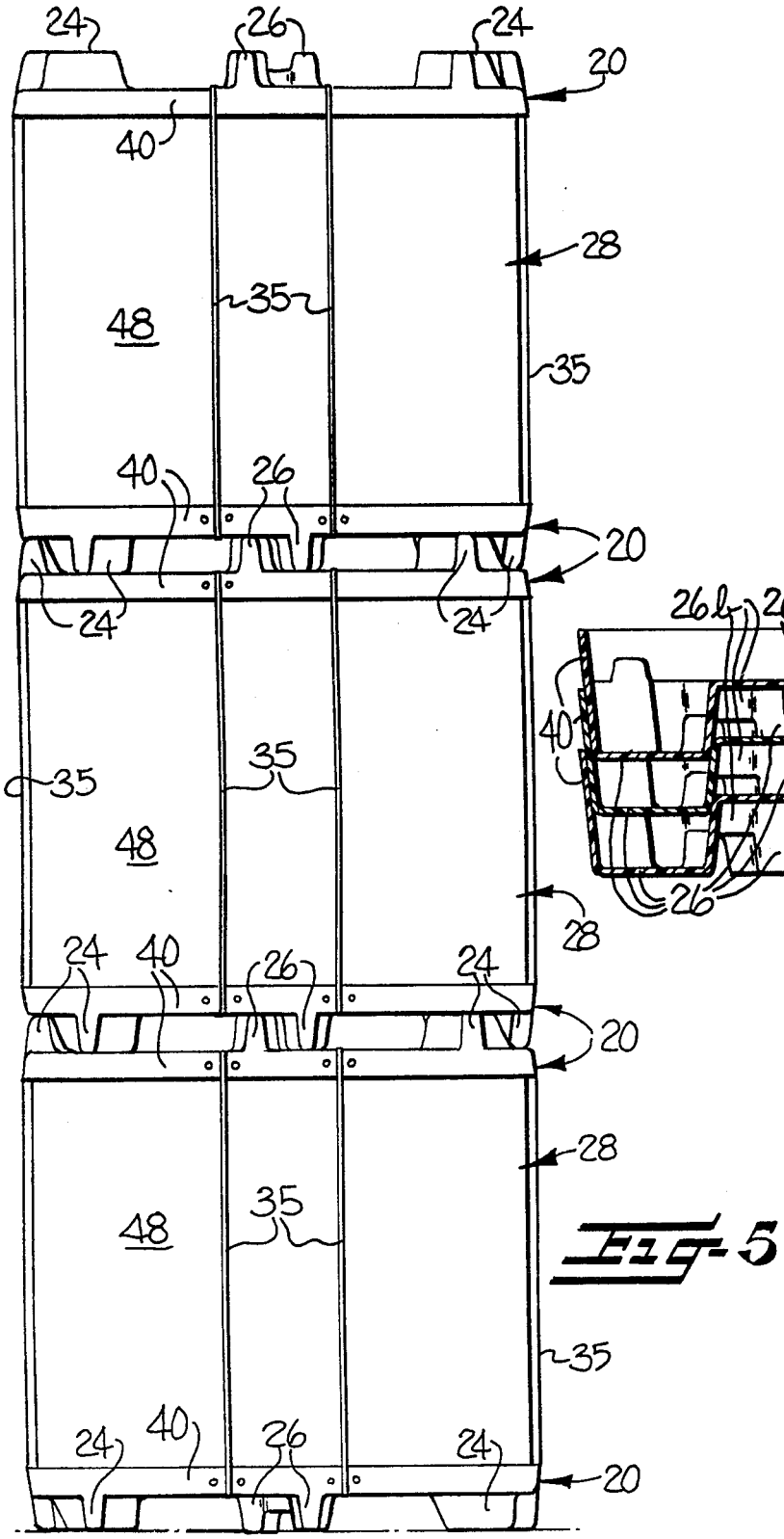
FIG. 5 is a side-elevation view of a stack of shipping containers in accordance with the embodiment of FIG. 1.
Figure 6:
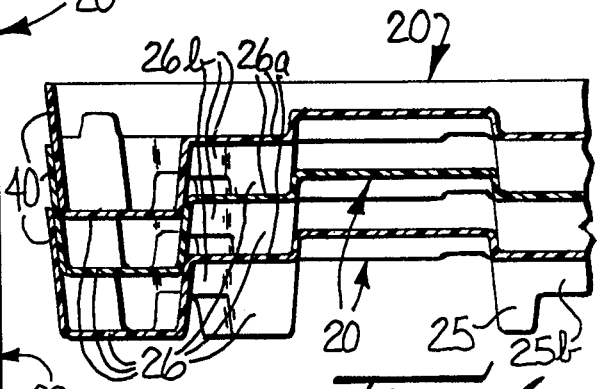
FIG. 6 is a fragmentary sectional side elevation view of a plurality of the pallets of the present invention in a nested relation.
Figure 7:
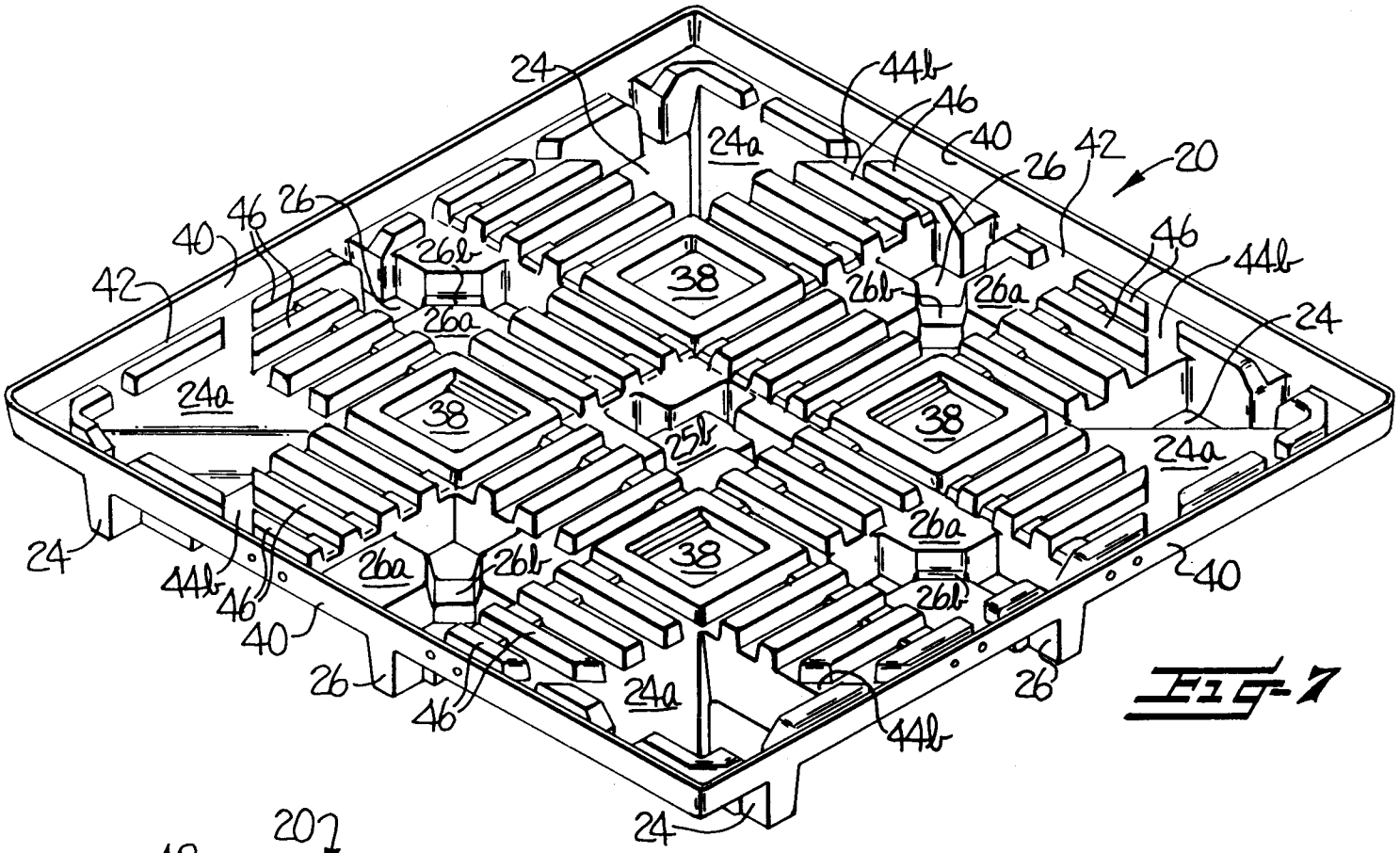
FIG. 7 is a top perspective view of the pallet of the present invention.
Figure 8:
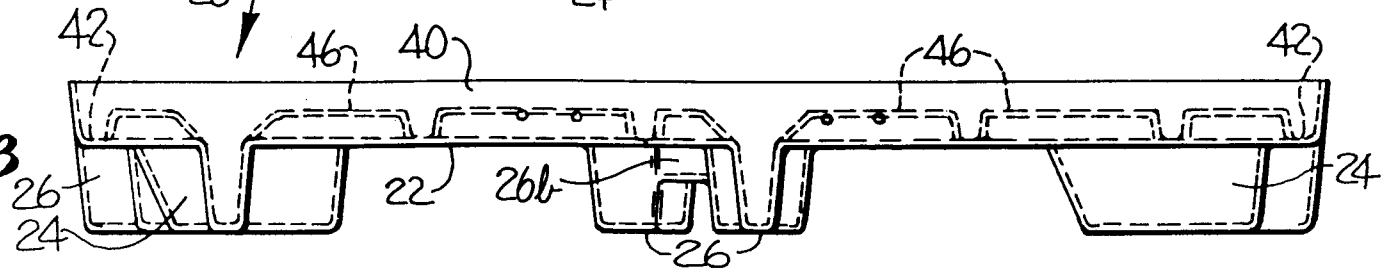
FIG. 8 is a side elevation view of the pallet shown in FIG. 7, viewed from any one of the four sides thereof.
Figure 15:
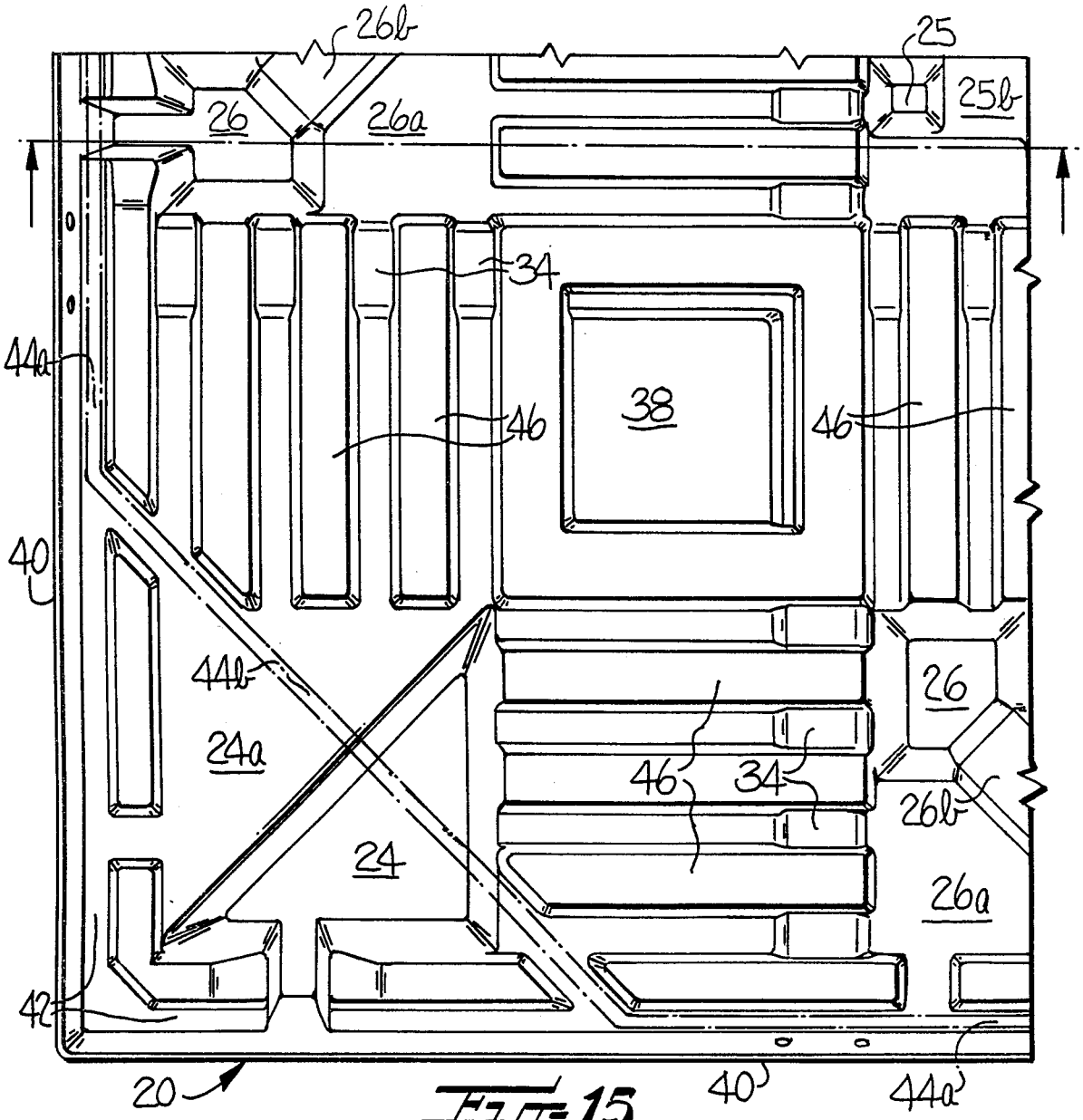
FIG. 15 is fragmentary top plan view showing one-quarter of the pallet.
Figure 16:
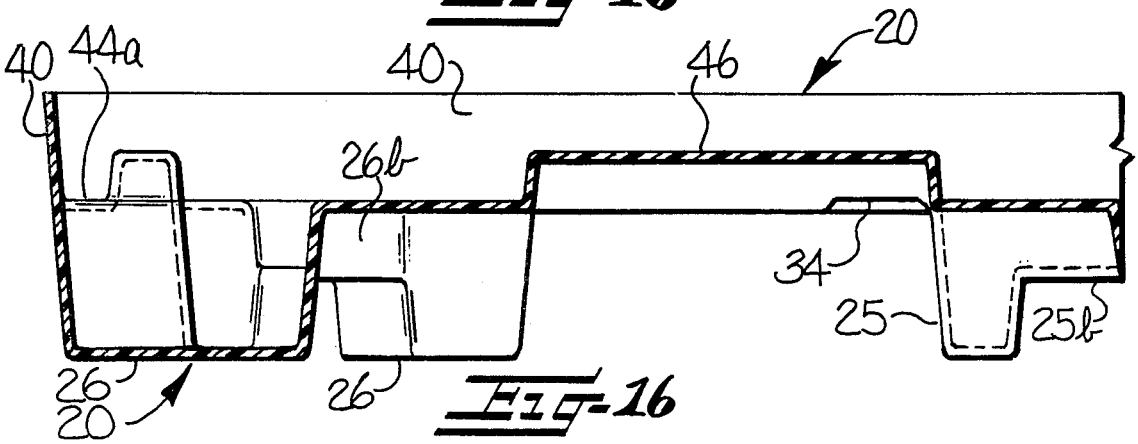
FIG. 16 is a fragmentary sectional side elevation view taken substantially along the lines 16—16 of FIG. 15.

As will be apparent from the various views, the projecting members are configured so as to permit the pallets to be nested in the manner shown in FIG. 6. Also, the projecting members are adapted to abut respective platform members of an adjacent, inverted pallet, so as to provide lateral interengagement between the two pallets which prevents lateral shifting therebetween. Thus, a number of containers 28 may be vertically stacked as shown in FIG. 5, with the projecting members effectively precluding lateral shifting between the containers. Since each quarter of the pallet (as shown in FIG. 15) is identical with each other quarter, the vertically adjacent containers may be stacked in any orientation with respect to each other. Stated in other words, each pallet of the container may be reoriented at any other position of orientation of an integral multiple of 90° out-of-phase from its previous stacked position relative to the adjacent containers.

Figure 18:
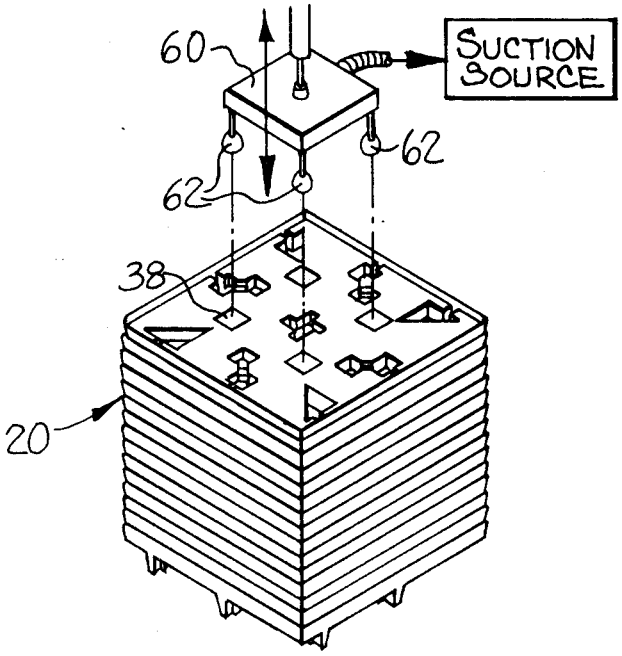
FIGS. 18 and 19 are schematic illustrations of the steps of removing individual pallets from each of the two stacks of pallets involved in the method of FIG. 17.
Figure 19:
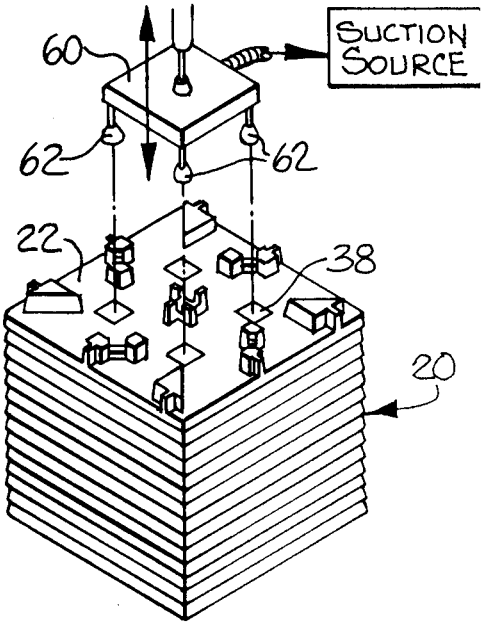

It will also be apparent that the projecting members of all of the foot means are arranged in such spaced relationship so as to provide a first pair of spaced parallel passages represented by the dashed lines 30 in FIG. 9, extending along opposite sides of a centerline passing through the pallet, and a second pair of spaced parallel passages, represented by the dashed lines 32 in FIG. 9, extending transversely of the first named passages, with the passages of each pair being arranged to accommodate the arms of a forklift type transporting vehicle or of a handtruck. The pallet further includes a channel 34 extending along each of the passages for receiving a strapping band 35, and grippable means in the form of four flat areas 38 positioned in the passages and adapted for engagement by suction devices or the like for facilitating the handling and assembly of the pallets into shipping containers, as hereinafter further described. The four flat areas 38 are disposed symmetrically about the center of the pallet, with each being approximately midway between the center and one of the corners. Also, the four flat areas are present on each side of the pallet, note FIGS. 18 and 19.

In accordance with the present invention, the pallet 20 further includes a peripheral rim 40 extending outwardly from the base on the side opposite the foot means. In addition, the rim 40 partially defines a first square sleeve receiving groove 42 which extends about the periphery of the pallet. The pallet also includes a second sleeve receiving groove on the same side of the pallet and positioned so as not to extend outwardly beyond the confines of the first groove. The second groove is indicated by the dashed lines in FIGS. 10 and 15, and is octagonal in outline and concentrically arranged relative to the first groove and relative to the pallet. More particularly, the second groove includes first linear portions 44*a* which coincide with linear portions of the first groove, and second portions 44*b* which cut diagonally across the corners of the pallet. Thus the first and second sleeve receiving grooves not only have coinciding linear portions and are concentrically arranged relative to each other and relative to the pallet, but additionally each groove as shown encompasses at least a major portion of the pallet, and further wherein the grooves are of different size and geometric shape from each other. A large portion of the base of the pallet includes rows of integrally molded reinforcing ribs 46, with some groupings of ribs extending in one direction and other groupings extending at right angles to the first groupings.

Figure 1:
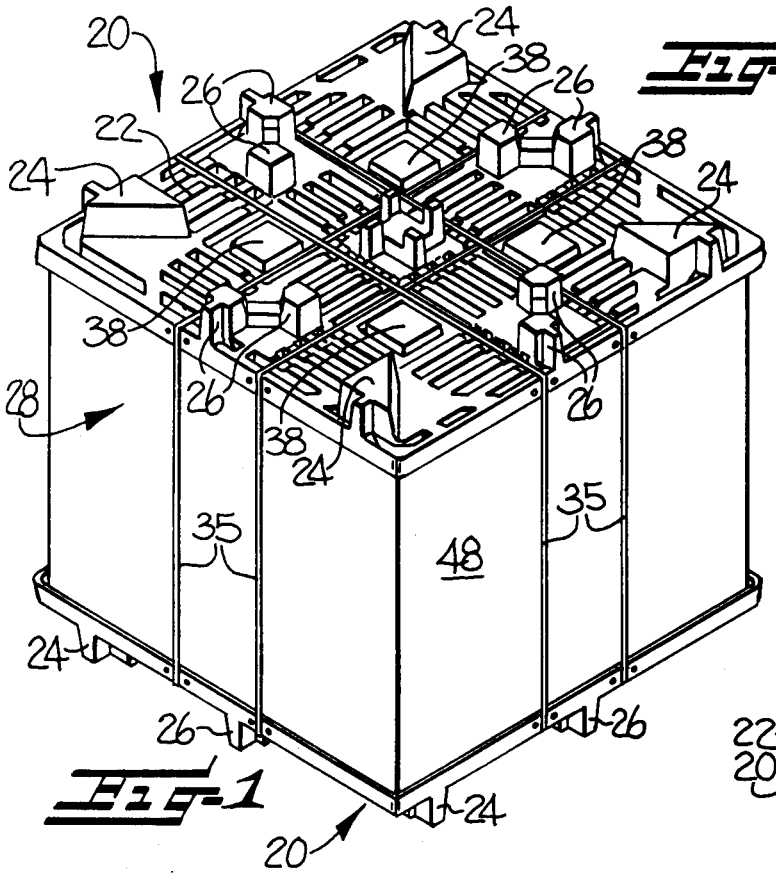
Figure 2:
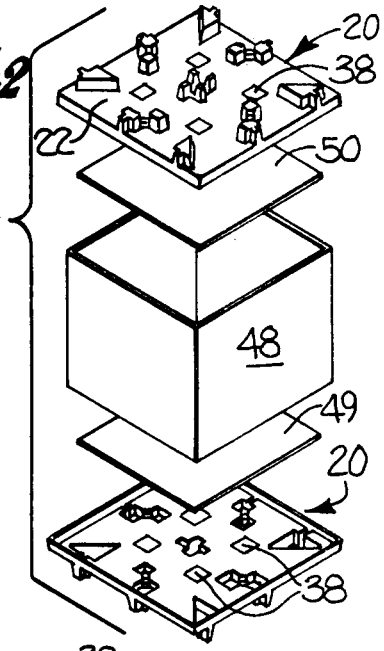
FIG. 2 is an exploded perspective view of the container shown in FIG. 1.

A shipping container 28 which embodies the features of the present invention is illustrated in FIG. 1, and which comprises upper and lower pallets 20 of substantially identical construction as described above. The upper and lower pallets are inverted relative to each other so as to be adapted to be stacked in mating relation to pallets of adjacent containers 28. A four-sided rectangular sleeve 48 extends between and is positioned in engagement with the upper and lower pallets. The sleeve 48 has a square cross-sectional configuration corresponding to that of the first sleeve receiving groove 42 of the two pallets and the opposite ends of the sleeve are positioned in such groove 42 so as to prevent the sleeve from shifting laterally with respect to the upper and lower pallets. The container may also include a bottom floor panel 49 of double wall corrugated paper or the like, and a similar cover panel 50, which are sized to be received within the sleeve. Also, the container may be held together by a plurality of strapping bands 35, with the bands being located and retained against lateral movement by the channels 34.

When the containers 28 are in stacked condition as shown in FIG. 5, the weight of the upper containers is transmitted from pallet to adjacent inverted pallet to sleeve, and likewise from sleeve to pallet to inverted pallet. Thus, the side walls formed by the sleeve become vertical load bearing members, and the payload within the container carries no significant portion of the vertical load. The interengagement between the sleeve 48 and groove 42 serves to provide dimensional stability to the sleeve and prevents outward bowing of the sidewalls thereof. In addition, the strapping bands 35 tend to resist outward bowing of the sidewalls.

Figure 3:
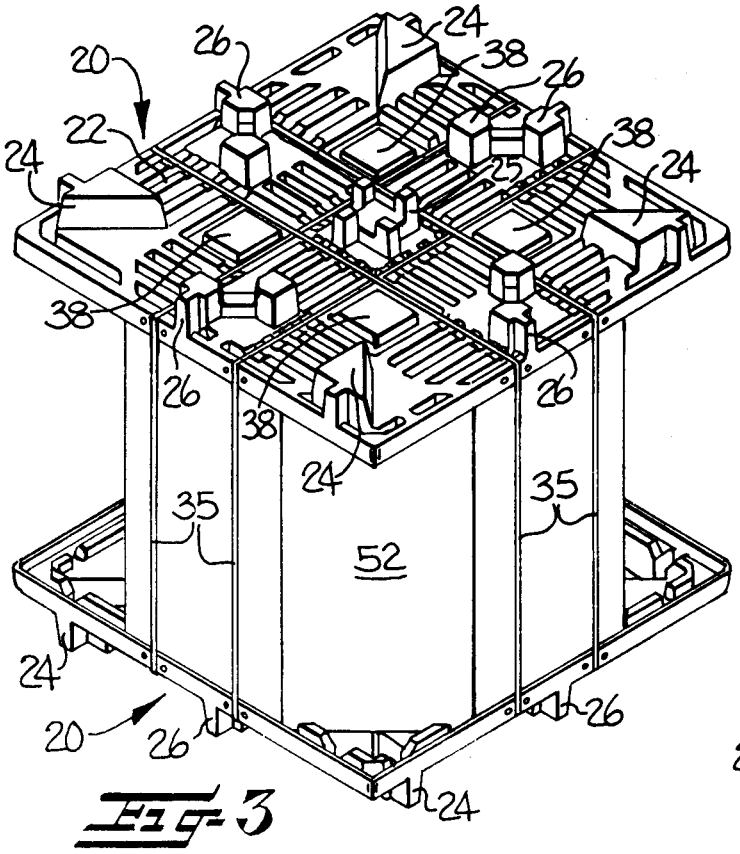
FIG. 3 is a perspective view of a second embodiment of a shipping container in accordance with the present invention.
Figure 4:
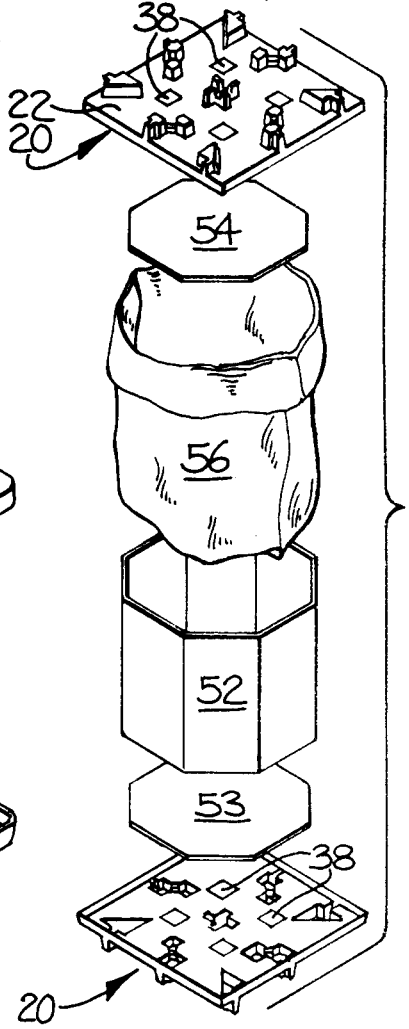
FIG. 4 is an exploded perspective view of the container shown in FIG. 3.

In the embodiment of FIGS. 3 and 4, the container 51 comprises two pallets 20 as described above, but includes a sleeve 52 of octagonal outline in cross-section. The sleeve 52 is sized to be received in the second groove 44*a*, 44*b* of the two pallets, and it provides improved load bearing strength by reason of its octagonal configuration. Also, the floor and cover panels 53, 54 of the container conform to the outline of the sleeve 52 so as to be received within the confines of the second groove 44. Further, in the specific illustrated embodiment, there is also included a bag 56 within the container for supporting granular or like substances.

Figure 17:
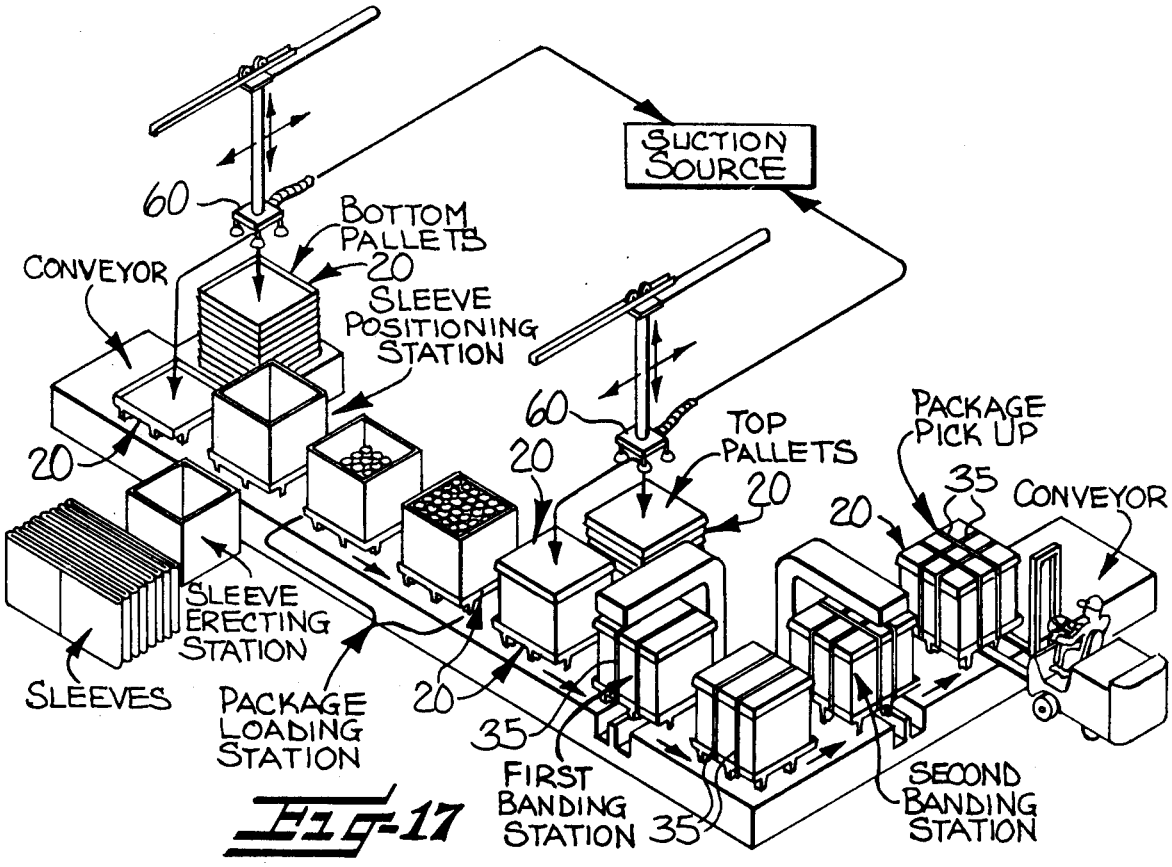
FIG. 17 is a schematic illustration of the steps involved in the method of producing shipping containers in accordance with the present invention.

FIG. 17 schematically illustrates a method of producing shipping containers 28 in accordance with the present invention. As illustrated, there is provided a conveyor having a right-angled turn along its length. Also, a first stack of pallets for forming the bottoms of the containers is positioned adjacent the upstream end of the conveyor, with the pallets disposed in a nested relation with the foot means thereof extending downwardly in the manner shown in FIG. 18. A second stack of nested pallets, and which are of the same construction as the pallets of the first stack, is positioned midway along the conveyor, but with the second stack being oriented with the foot means projecting upwardly in the manner shown in FIG. 19.

A suction device 60 is provided adjacent each of the stacks of pallets, for selectively lifting individual pallets from the stacks and depositing the same on the conveyor, or on a sleeve, as the case may be. As illustrated, the suction devices 60 each include four separate suction cups 62, which are disposed to engage each of the four flat areas 38 formed on each side of the pallets.

In operation, the pallets forming the bottoms of the containers are sequentially positioned on the upstream end of the conveyor by the suction device 60. A supply of collapsed sleeves 48 is also provided, with each sleeve having a cross-sectional configuration, when opened, corresponding to one of the first and second sleeve receiving grooves of the pallets. In the illustrated embodiment, the sleeves 48 have a square configuration, and conform to the outline of the first groove 42 in the pallets. A selected sleeve is opened and positioned with one end thereof disposed in the first groove 42 of the bottom pallet on the conveyor. The conveyor then transports the bottom pallet and sleeve past the package loading station where a product is placed within the sleeve, and thereafter, the uppermost inverted pallet from the second stack is removed and positioned on top of the sleeve so that the upper end of the sleeve is positioned within the first groove 42 of such pallet. Next, the container moves through a first banding station, and then a second banding station, wherein the upper and lower pallets are interconnected by the bands 35 for maintaining the integrity of the container. The finished container 28 may then be removed from the conveyor by a forklift truck.

As will be apparent to those skilled in the art, other means for grasping and lifting the pallet may be employed as an alternative to the illustrated flat ares 38. For example, openings may be formed in the pallet which are adapted to be penetrated by a suitable lifting device other than a suction operated device.

In the drawings and specification, there has been set forth a preferred embodiment of the invention, and although specific terms are employed, they are used in a generic and descriptive sense only and not for purposes of limitation.

That which is claimed is:

1. A shipping pallet of unitary construction for use with another substantially identical pallet so as to serve as a bottom or top wall of a shipping container for transporting and storing a load, said shipping pallet comprising a base and a plurality of spaced-apart foot means projecting from a common side of said base, a first sleeve receiving groove provided adjacent the periphery of the pallet and on the side thereof opposite from said foot means, and a second sleeve receiving groove provided on the same side of the pallet as said first sleeve receiving groove and positioned so as not to extend outwardly beyond the confines of said first sleeve receiving groove and being so constructed and arragned as to be of different configuration than said first sleeve receiving groove so as to receive a sleeve therein of different cross-sectional configuration than that sleeve adapted to be received in said first sleeve receiving groove, wherein said first and second sleeve receiving grooves have coinciding linear portions and are concentrically arranged relative to each other and relative to the pallet and each encompasses at least a major portion of the pallet, and further wherein the grooves are of different overall size and geometric shape from each other.

2. A shipping pallet according to claim 1 wherein said base includes grippable means disposed within the confines of said first and second grooves and adapted for engagement by a cooperating gripping device for facilitating the handling and assembling of the pallets into shipping containers.

3. A shipping pallet according to claim 2 wherein said grippable means comprises a plurality of discrete flat areas disposed symmetrically about the center of the pallet, with the flat areas being present on each side of said pallet.

4. A shipping pallet according to claim 1 wherein at least some of said spaced-apart foot means comprises a pair of spaced-apart projecting members and a pair of spaced-apart platform members, and a bridging member interconnecting each of the pairs of projecting members for strengthening the same, each bridging member projecting from the base a lesser distance than each pair of projecting members of said foot means.

5. A shipping pallet according to claim 1 wherein said spaced-apart foot means projecting from a common side of said base comprise corner foot means positioned in respective corner areas of the pallet, central foot means positioned centrally of the pallet, and intermediate foot means positioned between adjacent corner foot means, and wherein all of said intermediate and central foot means each comprise at least a pair of spaced-apart projecting members, and wherein a bridging member interconnects each of said pairs of projecting members for strengthening the same, each bridging member projecting from the base a lesser distance than said projecting member of said foot means.

6. A shipping pallet according to claim 1 wherein said projecting members of all of said spaced-apart foot means are arranged in such spaced relationship as to provide a pair of spaced parallel passages extending along opposite sides of a centerline passing through the shipping pallet and another pair of spaced parallel passages extending transversely of the first named passages, with the passages of each pair being arranged to accommodate the arms of a forklift type transporting vehicle, and wherein said base includes a plurality of substantially flat areas positioned in said passages and adapted for engagement by suction devices or the like for facilitating the handling and assembling of the pallets into shipping containers.

7. A shipping pallet according to claim 1 wherein each of said first and second sleeve receiving grooves have a polygonal outline, with the second groove having more sides than the first groove.

8. A shipping pallet according to claim 7 wherein said first sleeve receiving groove has a square outline, and said second sleeve receiving groove has an octagonal outline, and with four of the sides of said second groove coinciding with portions of each side of said first groove.

9. A shipping container for containing and transporting a load therein and so constructed as to be adapted to be stacked in mating relation with other shipping containers of substantially the same construction, said shipping container comprising upper and lower pallets of substantially identical construction, said upper and lower pallets being inverted relative to each other so as to be adapted to be stacked in mating relation to pallets of adjacent containers, a sleeve extending between and positioned in engagement with said upper and lower pallets, each of said pallets having a base and a plurality of spaced-apart foot means projecting from a common side of the base, each foot means comprising at least one projecting member and a platform member adjacent each projecting member, the projecting members and the platform members of each foot means being so constructed and arranged relative to each other that the projecting members of each pallet are adapted to abut the platform members of a pallet of an adjacent shipping container for providing a lateral anti-shift interengagement between adjacent shipping containers, a first sleeve receiving groove extending adjacent the periphery of each pallet and on the side thereof opposite from said foot means, a second sleeve receiving groove extending on the same side of each pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, said first and second sleeve receiving grooves having coinciding linear portions and also being concentrically arranged relative to each other and relative to the pallet, each groove encompassing at least a major portion of the pallet and being of different overall size and geometric shape from each other, said sleeve having a cross-sectional configuration corresponding to one of said first and second sleeve receiving grooves of each pallet, and opposite ends of said sleeve being positioned in said corresponding one of said first and second sleeve receiving grooves of each pallet so as to prevent the sleeve from shifting laterally with respect to the upper and lower pallets, and means interconnecting the upper and lower pallets for maintaining the integrity of the shipping container.

10. A shipping container according to claim 9 wherein said first sleeve receiving groove has a square outline, and said second sleeve receiving groove has an octagonal outline.

11. A shipping container according to claim 9 wherein said base includes a plurality of substantially flat areas adapted for engagement by suction devices or the like for facilitating the handling and assembling of the pallets into shipping containers.

12. A shipping container according to claim 9 wherein at least some of said spaced-apart foot means comprises a pair of spaced-apart projecting members and a pair of spaced-apart platform members, and a bridging member interconnecting each of the pairs of projecting members for strengthening the same, each bridging member projecting from the base a lesser distance than each pair of projecting members of said foot means.

13. A shipping container according to claim 9 wherein said spaced-apart foot means projecting from a common side of said base comprise corner foot means positioned in respective corner areas of the pallet, central foot means positioned centrally of the pallet, and intermediate foot means positioned between adjacent corner foot means, and wherein all of said intermediate and central foot means each comprise at least a pair of spaced-apart projecting members, and wherein a bridging member interconnects each of said pairs of projecting members for strengthening the same, each bridging member projecting from the base a lesser distance than said projecting member of said foot means.

14. A shipping container according to claim 9 wherein said projecting members of all of said spaced-apart foot means are arranged in such spaced relationship as to provide a pair of spaced parallel passages extending along opposite sides of a centerline passing through the shipping pallet and another pair of spaced parallel passages extending transversely of the first named passages, with the passages of each pair being arranged to accommodate the arms of a forklift type transporting vehicle, and wherein said base includes a plurality of substantially flat areas positioned in said passages and adapted for engagement by suction devices or the like for facilitating the handling and assembling of the pallets into shipping containers.

15. A shipping container according to claim 9 wherein said projecting members and said platform members are so constructed and arranged relative to each other that each pallet thereof, when in use in a predetermined position of orientation, and at least another position of orientation 180° out-of-phase therefrom, may be stacked in mating relation to a substantially identical inverted pallet of an adjacent container.

16. A shipping container according to claim 15 wherein each pallet has substantially the same length as the width thereof, and wherein the projecting members and the platform members are so constructed and arranged relative to each other that each pallet thereof, when in use, may be reoriented at any other position of orientation of an integral multiple of 90° out-of-phase from its previous stacked position relative to the adjacent containers.

17. A stack of shipping containers containing articles therein, each shipping container comprising upper and lower pallets of substantially the same construction, said upper and lower pallets of each shipping container being inverted relative to each other and being in mating relation to the pallets of adjacent containers of the stack, a sleeve extending between and positioned in engagement with said upper and lower pallets of each respective shipping container, each of said pallets having a base and a plurality of spaced-apart foot means projecting from a common side of the base, each foot means comprising at least one projecting member and a platform member adjacent each projecting member, the projecting members and the platform members of each foot means being so constructed and arranged relative to each other that the projecting members of each pallet abut the platform members of a pallet of an adjacent shipping container and provide a lateral anti-shift interengagement between adjacent shipping containers, a first sleeve receiving groove extending adjacent the periphery of each pallet and on the side thereof opposite from said foot means and a second sleeve receiving goove extending on the same side of each pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, said first and second sleeve receiving grooves having coinciding linear portions and also being concentrically arranged relative to each other and relative to the pallet, each groove encompassing at least a major portion of the pallet and being of different overall size and geometric shape from each other, said sleeve having a cross-sectional configuration corresponding to one of said first and second sleeve receiving grooves of each pallet, and opposite ends of said sleeve being positioned in said corresponding one of said first and second sleeve receiving grooves of each pallet so as to prevent the sleeve from shifting laterally with respect to the upper and lower pallets, and means interconnecting the upper and lower pallets of the shipping container for maintaining the integrity of the shipping container.

18. A shipping pallet of unitary construction for use with another substantially identical pallet so as to serve as a bottom or top wall of a shipping container for transporting and storing a load, said shipping pallet having a generally planar base and a plurality of foot means projecting from the base, said foot means including corner foot means positioned in respective corner areas of the pallet, central foot means positioned centrally of the pallet, and intermediate foot means positioned between adjacent corner foot means, and wherein each of the foot means comprises at least one projecting member and a platform member adjacent each projecting member, and said projecting members and said platform members being so constructed and arranged relative to each other that the pallet when in use in a predetermined position of orientation, and at least another position of orientation 180° out-of-phase therefrom, may be stacked in mating relation to a substantially identical inverted pallet and with the projecting members abutting the platform members of the inverted pallet and serving to provide a lateral anti-shift interengagement between the adjacent pallets in a plurality of directions, a first sleeve receiving groove provided adjacent the periphery of the pallet and on the side thereof opposite from said foot means, and a second sleeve receiving groove provided on the same side of the pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, wherein said first and second sleeve receiving grooves have coinciding linear portions and are concentrically arranged relative to each other and relative to the pallet and each encompasses at least a major portion of the pallet, and further wherein the grooves are of different overall size and geometric shape from each other.

19. A shipping pallet of the type which when unloaded may be nestably stacked with other like pallets, said pallet being of unitary construction for use with another substantially identical pallet so as to serve as a bottom or top wall of a shipping container for transporting and storing a load, said shipping pallet having a generally plannar base and a plurality of foot means projecting from the base, said foot means including corner foot means positioned in respective corner areas of the pallet, central foot means positioned centrally of the pallet, and intermediate foot means positioned between adjacent corner foot means, and wherein each of the foot means comprises at least one projecting member and platform member adjacent each projecting member, and said projecting members and said platform members being so constructed and arranged relative to each other that the pallet when in use in a predetermined position or orientation, and at least another position of orientation 180° out-of-phase therefrom, may be stacked in mating relation to a substantially identical inverted pallet and with the projecting members abutting the platform members of the inverted pallet and serving to provide a lateral anti-shift interengagement between the adjacent pallets in a plurality of directions, wherein the respective projecting members of each diagonally opposed pair of said corner foot means have side engagement surfaces facing in opposite directions from each other for providing the lateral anti-shift interengagement between adjacent pallets when in stacked relationship, and further wherein said projecting members are hollow and constucted so as to be nestably engaged with projecting members of another substantially identical unloaded pallet facing the same direction and in any of said positions of orientation, whereby a relatively large number of unloaded pallets may be nestably stacked so as to occupy considerably less space when being stored or shipped, a first sleeve receiving groove provided adjacent the periphery of the pallet and on the side thereof opposite from said foot means, and a second sleeve receiving groove provided on the same side of the pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, wherein said first and second sleeve receiving grooves have coinciding linear portions and are concentrically arranged relative to each other and relative to the pallet and each encompasses at least a major portion of the pallet, and further wherein the grooves are of different overall size and geometric shape from each other.

20. A shipping container for containing and transporting a load therein and so constructed as to be adapted to be stacked in mating relation with other shipping containers of substantially the same construction, said shipping container comprising upper and lower pallets of substantially identical construction, said upper and lower pallets being inverted relative to each other so as to be adapted to be stacked in mating relation to the pallets of adjacent containers, a sleeve extending between and positioned in engagement with said upper and lower pallets, means interconnecting the upper and lower pallets of the shipping container for maintaining the integrity of the shipping container, each of said pallets having a generally planar base and a plurality of foot means projecting from the base, said foot means including corner foot means positioned in respective corner areas of the pallet, central foot means positioned centrally of the pallet, and intermediate foot means positioned between adjacent corner foot means, each of the foot means comprising at least one projecting member, the projecting members and the platform members of each pallet being so constructed and arranged relative to each other that the projecting members of each pallet are adapted to abut the platform members of a pallet of an adjacent shipping container for providing a lateral anti-shift interengagement between adjacent shipping containers, and wherein the projecting members and the platform members of each pallet are also so constructed and arranged that the shipping container, when in the stack, is adapted to be reoriented in at least another position of orientation 180° out-of-phase from its previous stacked position relative to other shipping containers in the stack, with the pallets of the reoriented shipping container still adapted to be in mating relation to the adjacent pallets of adjacent shipping containers in the stack and with the projecting members of each pallet of the reoriented shipping container adapted to be abutting the platform members of adjacent pallets, each pallet having a first sleeve receiving groove provided adjacent the periphery of the pallet and on the side thereof opposite from said foot means, and a second sleeve receiving groove provided on the same side of the pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, said sleeve having a cross-sectional configuration corresponding to one of said first and second sleeve receiving grooves of each pallet, opposite ends of said sleeve being positioned in said corresponding one of said first and second sleeve receiving grooves of each pallet so as to prevent the sleeve from shifting laterally with respect to the upper and lower pallets, said first and second sleeve receiving grooves in each pallet having coinciding linear portions and also being concentrically arranged relative to each other and relative to the pallet, each groove encompassing at least a major portion of the pallet, and further wherein the grooves are of different overall size and geometric shape from each other.

21. A shipping container for containing and transporting a load therein and so constructed as to be adapted to be stacked in mating relation with other shipping containers of substantially the same construction, said shipping container comprising upper and lower pallets of substantially identical construction and which when unloaded may be nestably stacked with other like pallets, said upper and lower pallets being inverted relative to each other so as to be adapted to be stacked in mating relation to the pallets of adjacent containers, a sleeve extending between and positioned in engagement with said upper and lower pallets, means interconnecting the upper and lower pallets of the shipping container for maintaining the integrity of the shipping container, each of said pallets having a generally planar base and a plurality of foot means projecting from the base, said foot means including corner foot means positioned in respective corner areas of the pallet, central foot means positioned centrally of the pallet, and intermediate foot means positioned between adjacent corner foot means, each of the foot means comprising at least one projecting member and a platform member adjacent each projecting member, the projecting members and the platform members of each pallet being so constructed and arranged relative to each other that the projecting members of each pallet are adapted to abut the platform members of a pallet of an adjacent shipping container for providing a lateral anti-shift interengagement between adjacent shipping containers, and wherein the projecting members and the platform members of each pallet are also so constructed and arranged that the shipping container, when in the stack, is adapted to be reoriented in at least another position of orientation 180° out-of-phase from its previous stacked position relative to other shipping containers in the stack, with the pallets of the reoriented shipping container still adapted to be in mating relation to the adjacent pallets of adjacent shipping containers in the stack and with the projecting members of each pallet of the reoriented shipping container adapted to be abutting the platform members of adjacent pallets, the respective projecting members of each diagonally opposed pair of said corner foot means of each pallet having side engagement surfaces facing in opposite directions from each other for providing the lateral anti-shift interengagement between adjacent pallets when in stacked relationship, and further wherein said projecting members of each pallet are hollow and constucted as to be nestably engaged with projecting members of another substantially identical unloaded pallet facing in the same direction and in any of said positions of orientation, whereby a relatively large number of unloaded pallets may be nestably stacked so as to occupy considerably less space when being stored or shipped, each pallet having a first sleeve receiving groove provided adjacent the periphery of the pallet and on the side thereof opposite from said foot means, and a second sleeve receiving groove provided on the same side of the pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, said sleeve having a cross-sectional configuration corresponding to one of said first and second sleeve receiving grooves of each pallet, opposite ends of said sleeve being positioned in said corresponding one of said first and second sleeve receiving grooves of each pallet so as to prevent the sleeve from shifting laterally with respect to the upper and lower pallets, said first and second sleeve receiving grooves in each pallet having coinciding linear portions and also being concentrically arranged relative to each other and relative to the pallet, each groove encompassing at least a major portion of the pallet, and further wherein the grooves are of different overall size and geometric shape from each other.

22. A stack of shipping containers containing articles therein, each shipping container comprising upper and lower pallets of substantially the same construction, said upper and lower pallets of each shipping container being inverted relative to each other and being in mating relation to the pallets of adjacent containers of the stack, a sleeve extending between and positioned in engagement with said upper and lower pallets, means interconnecting the upper and lower pallets of each shipping container for maintaining the integrity of the shipping container, each of said pallets having a generally planar base and a plurality of foot means projecting from the base, said foot means including corner foot means positioned in respective corner areas of the pallet, central foot means positioned centrally of the pallet, and intermediate foot means positioned between adjacent corner foot means, each of the foot means comprising at least one projecting member and a platform member adjacent each projecting member, the projecting members and the platform members of each pallet being so constructed and arranged that the projecting members of each pallet abut the platform members of a pallet of an adjacent shipping container and provide a lateral anti-shift interengagement between adjacent shipping containers, and wherein the projecting members and the platform members of each pallet are also so constructed and arranged that each shipping container of the stack may be reoriented at at least another position of orientation 180° out-of-phase from its previous stacked position relative to the other shipping containers, with the pallets of the reoriented shipping container still being in mating relation to the adjacent pallets and with the projecting members of each pallet of the reoriented shipping container abutting the platform members of the adjacent pallets, each pallet having a first sleeve receiving groove provided adjacent the periphery of the pallet and on the side thereof opposite from said foot means, and a second sleeve receiving groove provided on the same side of the pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, said sleeve having a cross-sectional configuration corresponding to one of said first and second sleeve receiving grooves of each pallet, opposite ends of said sleeve being positioned in said corresponding one of said first and second sleeve receiving grooves of each pallet so as to prevent the sleeve from shifting laterally with respect to the upper and lower pallets, said first and second sleeve receiving grooves in each pallet having coinciding linear portions and also being concentrically arranged relative to each other and relative to the pallet, each groove encompassing at least a major portion of the pallet, and further wherein the grooves are of different overall size and geometric shape from each other.

23. A stack of shipping containers containing articles therein, each shipping container comprising upper and lower pallets of substantially the same construction and which when unloaded may be stacked with other like pallets, said upper and lower pallets of each shipping container being inverted relative to each other and being in mating relation to the pallets of adjacent containers of the stack, a sleeve extending between and positioned in engagement with said upper and lower pallets, means interconnecting the upper and lower pallets of each shipping container for maintaining the integrity of the shipping container, each of said pallets having a generally planar base and a plurality of foot means projecting from the base, said foot means including corner foot means positioned in respective corner areas of the pallet, central foot means positioned centrally of the pallet, and intermediate foot means positioned between adjacent corner foot means, each of the foot means comprising at least one projecting member and a platform member adjacent each projecting member, the projecting members and the platform members of each pallet being so constructed and arranged that the projecting members of each pallet abut the platform members of a pallet of an adjacent shipping container and provide a lateral anti-shift interengagement between adjacent shipping containers, and wherein the projecting members and the platform members of each pallet are also so constructed and arranged that each shipping container of the stack may be reoriented in at least another position of orientation 180° out-of-phase from its previous stacked position relative to the other shipping containers, with the pallets of the reoriented shipping container still being in mating relation to the adjacent pallets and with the projecting members of each pallet of the reoriented shipping container abutting the platform members of the adjacent pallets, the respective projecting members of each diagonally opposed pair of said corner foot means of each pallet having side engagement surfaces facing in opposite directions from each other for providing the lateral anti-shift interengagement between adjacent pallets when in stacked relationship, and further wherein said projecting members of each pallet are hollow and constructed so as to be nestably engaged with projecting members of another substantially identical unloaded Pallet facing in the same direction and in any of said positions of orientation, whereby a relatively large number of unloaded pallets may be nestably stacked so as to occupy considerably less space when being stored or shipped, each pallet having a first sleeve receiving groove provided adjacent the periphery of the pallet and on the side thereof opposite from said foot means, and a second sleeve receiving groove provided on the same side of the pallet as said first sleeve receiving groove and positioned so as not to extend outwardly beyond the confines of said first sleeve receiving groove and being so constructed and arranged as to be of different configuration than said first sleeve receiving groove so as to receive a sleeve therein of different cross-sectional configuration than that sleeve adapted to be received in said first sleeve receiving groove, said sleeve having a cross-sectional configuration corresponding to one of said first and second sleeve receiving grooves of each pallet, opposite ends of said sleeve being positioned in said corresponding one of said first and second sleeve receiving grooves of each pallet so as to prevent the sleeve from shifting laterally with respect to the upper and lower pallets, said first and second sleeve receiving grooves in each pallet having coinciding linear portions and also being concentrically arranged relative to each other and relative to the pallet, each groove encompassing at least a major portion of the pallet, and further wherein the grooves are of different overall size and geometric shape from each other.

* * * * *